United States Patent [19]

Fraser, Jr.

[11] 4,374,630

[45] Feb. 22, 1983

[54] ANCHOR CONNECTOR FOR TENSION LEG

[75] Inventor: Thomas A. Fraser, Jr., Ventura, Calif.

[73] Assignee: Vetco Offshore, Inc., Ventura, Calif.

[21] Appl. No.: 180,225

[22] Filed: Aug. 21, 1980

[51] Int. Cl.[3] ..... E02D 5/54

[52] U.S. Cl. ..... 405/224; 405/195

[58] Field of Search ..... 405/224, 168, 170, 169, 405/195; 285/307; 114/264, 265, 293

[56] References Cited

U.S. PATENT DOCUMENTS

| | | | |
|---|---|---|---|
| 3,096,999 | 7/1963 | Ahlstone et al. | 166/340 |
| 3,448,799 | 6/1969 | Ahlstone et al. | 166/340 |
| 4,248,549 | 2/1981 | Czerewaly | 405/224 |

*Primary Examiner*—Dennis L. Taylor

*Attorney, Agent, or Firm*—Edward L. Kochey, Jr.

[57] ABSTRACT

An anchor connector with a latch segment retainer body (28) having a lost motion connection to the connector body (36) which has a downwardly-extending skirt (38). Latch segments (30) pivotally connected to the retainer body are free to swing outwardly when the retainer body is retained in its upward position but are locked against the groove (24) in a support mandrel (22) when the retainer body is in its downward position. The latch segments engage the mandrel with a boss (32) which has a tapered upper surface (34) to ensure outward movement for disengagement, and a tapered lower surface (50) which permits diver assist disengagement in the event of a malfunction.

3 Claims, 3 Drawing Figures

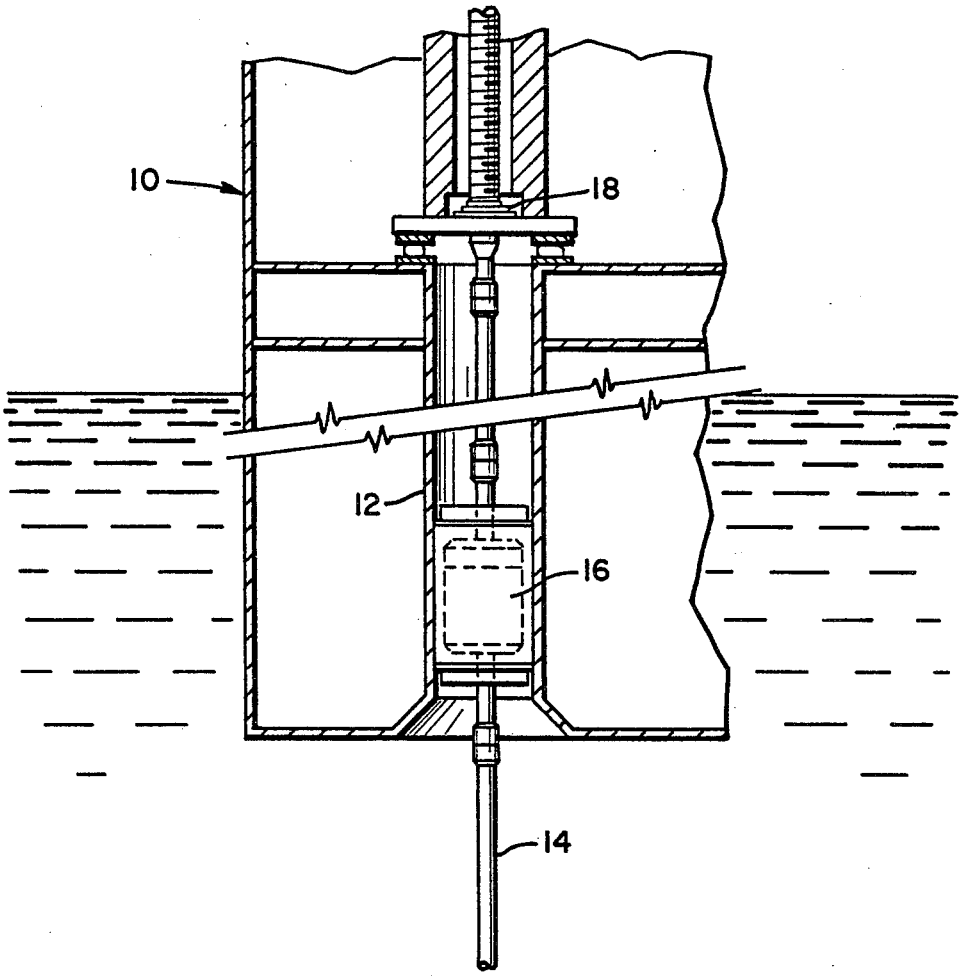
FIG. 1
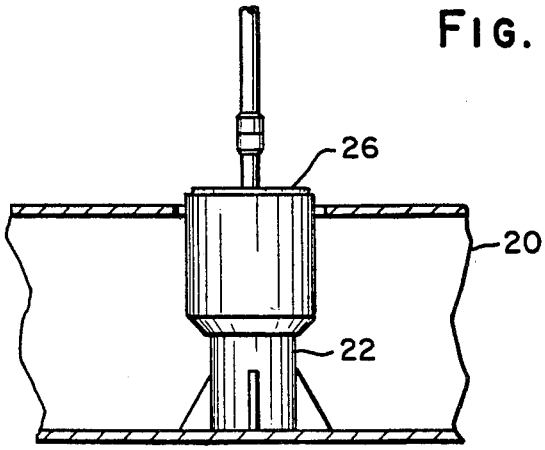

ANCHOR CONNECTOR FOR TENSION LEG

BACKGROUND OF THE INVENTION

This invention relates to anchor pile connectors and in particular to releasable connectors for securing the tension legs of a tensioned leg platform. After an offshore well is drilled from a floating platform, it may be desirable to produce the well to a later-installed tensioned leg platform. These platforms, while supported by the buoyancy of the water, are not freely floating but are tied back to a plurality of anchors and tensioned from the seabed. Typically, a plurality of tension lines are located at each corner of the platform and all are maintained continuously in tension although the amount of tension may vary and the lines may vary up to 15 degrees from the vertical at the anchor location.

An anchor template is secured to the seabed with driven and/or drilled and cemented piles. The tension legs are run from the various anchor templates to the platform. Each is typically a 23 cm OD by 8 cm ID tubular member in threaded sections, operating under a nominal tension of 1,000 tons. For the purpose of inspecting these lines at a later date, it is desirable to retrieve the entire string of a particular leg while the remaining legs continue to carry the load.

Other anchor connectors for tensioned leg platforms are based on an arrangement where the anchor locks only if there is continued tension. A loss of tension resulting in a reversal of forces at the connector operates to disconnect the leg with possible subsequent damage to the platform and equipment operating from the platform. Other possible schemes considered require complex operating mechanisms and structures which result in stress concentrations in the connector. Furthermore, it is helpful to have a connector which can be disconnected with diver assistance in the event that the primary disconnect apparatus malfunctions.

SUMMARY OF THE INVENTION

The anchor connector operates to connect a tension leg of a tensioned leg platform to a piled anchor template carrying a mandrel which has a circumferential groove to which the connector is to be attached. A generally-cylindrical latch segment retainer body supports a plurality of latch segments which are pivotally supported and depending from the retainer body. Each of these segments has an inwardly-extending boss at its lower end which will engage the annular groove on the mandrel. The upper edge of each boss is sloped upwardly from the center of the mandrel so that an upward pull will urge the dogs outwardly.

The connector body has a downwardly-extending skirt surrounding the latch segments and the retainer body, and has an axial lost motion connection between itself and the retainer body, so that the retainer body has an upper position and a lower position with respect to the connector body. When the retainer body is in its lower position, the skirt abuts the outer edge of the latch segments to prevent their outward movement and also abuts the lower edge to permit force to be transmitted through the latch segment to the mandrel.

The skirt has an internal recess above the lower end so that when the retainer body is in its upward position, the latch segments are free to pivot outwardly out of engagement with the mandrel. An internal dart is dropped through the tension line, resting on a shoulder in the connector body and latching into the retainer body only when it is in its upward position. Once latched it retains the retainer body in the upward position so that the connector may be disconnected. With the dart removed, the retainer body always remains in the lowest possible position. Unless lifted by the connector body, it remains on the mandrel. If the connector body is in its downward position, there is no force to be retained while if the connector body is in its upward position, the latch segments are locked into position.

The latch segments also have on their lower edge, at least on the inside edge, a portion which is sloped downwardly away from the center of the anchor pile. Should there in some event be a failure in the ability to retain the retainer body with the connector body, the connector body can be dropped downwardly with shims thrust upwardly between the mandrel and the latch segments to force them outwardly.

BRIEF DESCRIPTION OF THE DRAWINGS

FIG. 1 is a general arrangement showing a tensioned leg platform and an anchor;

DESCRIPTION OF THE PREFERRED EMBODIMENT

Figure 2:
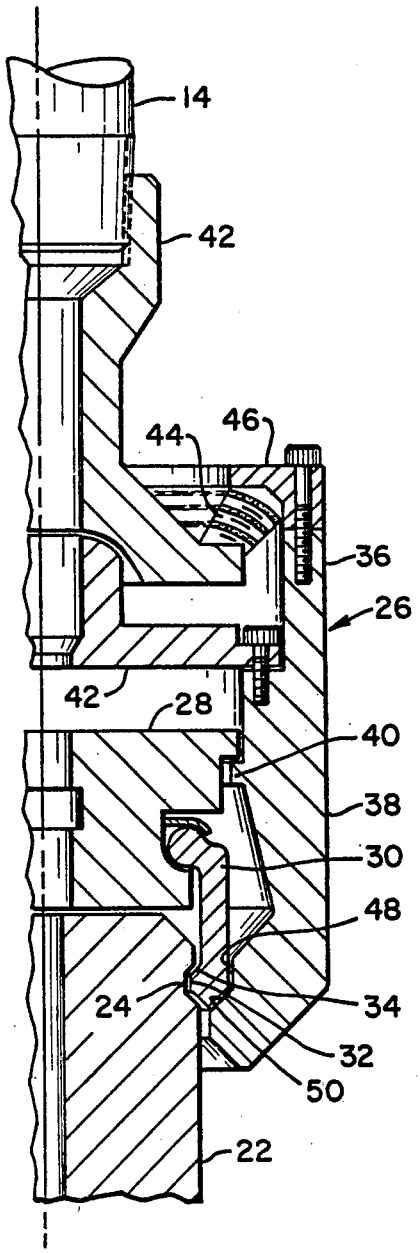
FIG. 2 shows the connector in its latched condition.

A platform 10 includes a mooring tunnel 12 through which passes the tension leg 14. This tension leg includes an upper flexible element 16 and is supported above the water line by a locking collar 18. An anchor template 20 is secured to the seabed through driven and/or drilled and cemented pilings. The template includes a cylindrical mandrel 22 which is anchored to the template 20. The mandrel has an annular groove 24 around its periphery near the upper end.

FIG. 2 illustrates the anchor connector 26 in its locked position. A cylindrical latch segment retainer body 28 carries a plurality of latch segments 30 which are pivotally supported from the retainer body and depend from the body. These segments are located in an annular array around the retainer body.

Each of the latch segments 30 has an inwardly-extending boss 32 at its lower end which is sized to engage the annular groove 24. The upper edge of the boss is sloped upwardly from the center of the annular array. Accordingly, an upward force on the latch segments will cause the segments to tend to swing outwardly out of engagement.

The connector body 36 has a downwardly-extending skirt 38 surrounding the latch segments and the retainer body. The latch segment retainer body is secured to the connector body through a lost motion connection between shoulder 40 and a support post structure 42. The retainer body 28 is free to move axially through this limited distance. The retainer body is illustrated in FIG. 2 in its lower position.

The connector body also includes an upper portion 42 which is threadedly connected to the tension leg 14. The body also includes a spherical elastomeric bearing element 44 and a bearing retainer plate 46.

The connector body skirt 38 has at its lower end a first surface 48 which abuts the outer edge of latch segments 30 thereby preventing their outward movement in the position illustrated in FIG. 2. The skirt also includes a second load surface 50 which abuts the bottom edge of the latch segments thereby transmitting a vertical load through the connector body 36, the load surface 50, and the latch segments 30 into the mandrel 22.

Figure 3:
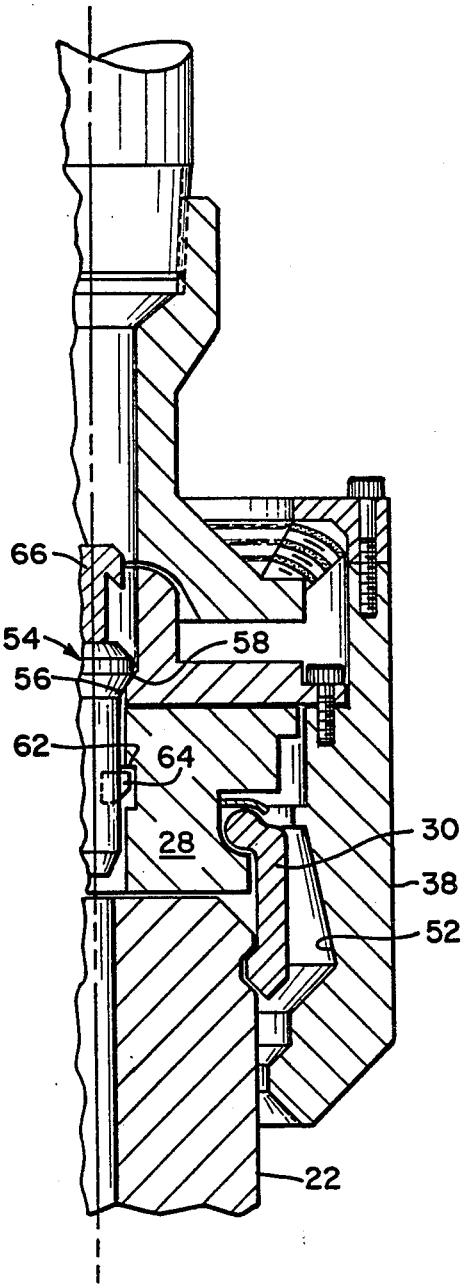
FIG. 3 shows the connector in its unlatched condition.

FIG. 3 illustrates the anchor connector 26 in its released position. The latch segment retainer body 28 is illustrated here in its upper position. With the retainer body in its upper position, the latch segments 30 are raised with respect to the connector body 36 to an elevation where the skirt 38 has an internal recess 52 sufficient to permit the latch segments 30 to pivot outwardly out of engagement with the groove 24.

A means for selectively retaining the latch segment retainer body in its upper position is provided in the form of a longitudinally-extending dart 54. With tension removed from the leg 14, the connector drops to its position illustrated in FIG. 3; and the dart 54 is dropped from the surface through the inside diameter of the tension leg 14. This dart has a shoulder 56 which abuts an inwardly-extending, upwardly-facing support shoulder 58 on the connector. The retainer body 28 has a longitudinally-extending internal opening including a recess 60 and an inwardly-extending, downwardly-facing retaining shoulder 62. The dart includes horizontally-extending dogs 64 which may be in the form of a snap ring and which are sprung outwardly so that they snap into the groove in the latch segment retainer body 28. This dart thereby locks together the latch segment retainer body 28 and the connector body 36, thereby retaining the latch segment retainer body in its upper position. It is pointed out that the releasing dart 54 is not capable of lifting the retainer body to this position but only capable of retaining it in the position once it has been placed in the upper position by releasing tension on the tension leg 14.

With the releasing dart 54 in place as illustrated in FIG. 3, an upward pull on the connector body causes the latch segments 30 to cam outwardly thereby effecting release of the pile connector. Since the load must first be released before releasing dart 54 may engage the retainer body, it is not possible to have a sudden release of the apparatus while the connector is under load. The load in all cases must first be released.

So long as the releasing dart 54 is in place, the connector will be maintained in its released position. The releasing dart includes on its upper end a fishneck profile 66 which may be engaged by a fishline either remotely or at the surface. The dart is arranged so that tension on the fishneck pulls in the dogs 64 thereby effecting release of the dart. Once the dart is released, the latch segment retainer body is free to float through the lost motion connection between it and the connector body 36.

With the latch segment retainer body 28 released, it would be in the position illustrated in FIG. 2 as the connector approaches the mandrel. The latch segments 30 would engage the top of the mandrel 22, thereby forcing the latch segment retainer body 28 upwardly until the latch segments are free to rotate into the annular recess 52. As the segments pass the upper edge of the mandrel and reach the level of the groove 24, they swing inwardly to the position illustrated in FIG. 3. Subsequent upward movement of the connector locks the segments into place as illustrated in FIG. 2. If tension is inadvertently lost, the pile connector will drop to the position illustrated in FIG. 3 but without the dart in place. Accordingly, subsequent tension will retain the connector in its locked condition. Only retaining the retainer body in the upward position while the connector body is being raised will permit disengagement of the apparatus.

The connector is simple and reliable and provides an ideal load path since there are no dog windows, grooves, etc. in the connector body which would cause stress concentrations and possible fatigue damage. The connector automatically locks and stays locked so long as the releasing dart is not in place. Funnel extensions may be supplied on the skirt 38 if desired to facilitate stabbing.

The lower edge of each of the latch segments 30 has the inner portion sloped downwardly from the center of the annular array. This not only facilitates camming outwardly of the latches when the connection is being established but also provides for a diver assist backup release. Should one, for some reason, be unable to retain the retainer body with the body connector, the load may be released placing the apparatus in the condition illustrated in FIG. 3. Vertical shims may then be installed from below between the lower edge of the skirt and the pile which contact the sloped inner edge and force the latch outwardly. Raising the connector with the shims in place will retain the latch segments 30 in the recess 52 so that the anchor pile connector will disconnect. Other methods of retaining the retainer body in the upper position may be used.

I claim:

1. An anchor connector for connecting a tension leg of a tensioned leg platform to a cylindrical mandrel having a circumferential groove around the outer periphery comprising: a generally cylindrical latch segment retainer body; a plurality of latch segments pivotally supported and depending from said retainer body in an annular array, each segment having an inwardly-extending boss at its lower end sized to engage the annular groove, the upper edge of said boss sloped upwardly from the center of the annular array; a connector body having a downwardly-extending skirt surrounding said latch segments and said retainer body, and having an axial lost motion connection to said retainer body, whereby said retainer body has an upper position and a lower position with respect to the connector body; said skirt having at its lower end surface abutting the outer edge and bottom edge of the lower portion of said latch segments, when said retainer body is in its lower position, and having an internal recess above the lower end for permitting said latch segments to pivot outwardly when said retainer body is in the upper position; and means for selectively locking said retainer body to said connector body in the upper position.

2. An apparatus as in claim 1 wherein said connector body also has an inwardly-extending, upwardly-facing support shoulder at a location above said retainer body; said retainer body having an internal opening and an inwardly-extending, downwardly-facing retaining shoulder; said means for selectively retaining said retainer body in the upper position comprising, a longitudinally-extending dart having an upper shoulder for engaging said support shoulder and at least one horizontally-extending dog for engaging said retaining shoulder, said dog shoulder and said dog spaced to simultaneously engage said support and retaining shoulders only when said retainer body is in its upper position; and means for releasing said dogs.

3. An apparatus as in claim 1 or 2 wherein the lower edge of each of said latch segments has at least the inner portion of the lower edge sloped downwardly from the center of the annular array.

* * * * *